United States Patent [19]

Kay

[11] 4,433,269

[45] Feb. 21, 1984

[54] AIR FIREABLE INK

[75] Inventor: Nicholas W. Kay, Mine Hill, N.J.

[73] Assignee: Burroughs Corporation, Detroit, Mich.

[21] Appl. No.: 443,581

[22] Filed: Nov. 22, 1982

[51] Int. Cl.[3] ..... H01J 17/00

[52] U.S. Cl. ..... 313/632; 252/513; 252/512; 106/1.05; 106/20; 313/517; 313/519; 313/633

[58] Field of Search ..... 252/513, 512, 518; 106/1.05, 1.12, 20; 313/484, 491, 492, 631, 632, 633, 517, 519, 584, 585; 315/169.3, 169.4

[56] References Cited

U.S. PATENT DOCUMENTS

| | | | |
|---|---|---|---|
| 3,647,532 | 3/1972 | Friedman | 252/513 |
| 3,868,535 | 2/1975 | Kupsky | 313/519 |
| 4,070,517 | 6/1978 | Kazmierowicz | 252/513 |
| 4,100,524 | 7/1978 | Kirsch | 252/513 |
| 4,122,232 | 10/1978 | Kuo | 252/513 |
| 4,207,369 | 6/1980 | Kazmierowicz | 252/512 X |
| 4,255,291 | 3/1981 | Neede et al. | 252/512 |
| 4,298,505 | 11/1981 | Dorfeld et al. | 252/513 |

*Primary Examiner*—Josephine Barr

*Attorney, Agent, or Firm*—Kevin R. Peterson; Edmund M. Chung; Robert A. Green

[57] ABSTRACT

A screenable ink for forming conductors in a gas-filled display panel including aluminum and an aluminum alloy as important constituents and a panel including such conductors as reinforcing transparent conductive films.

6 Claims, 1 Drawing Figure

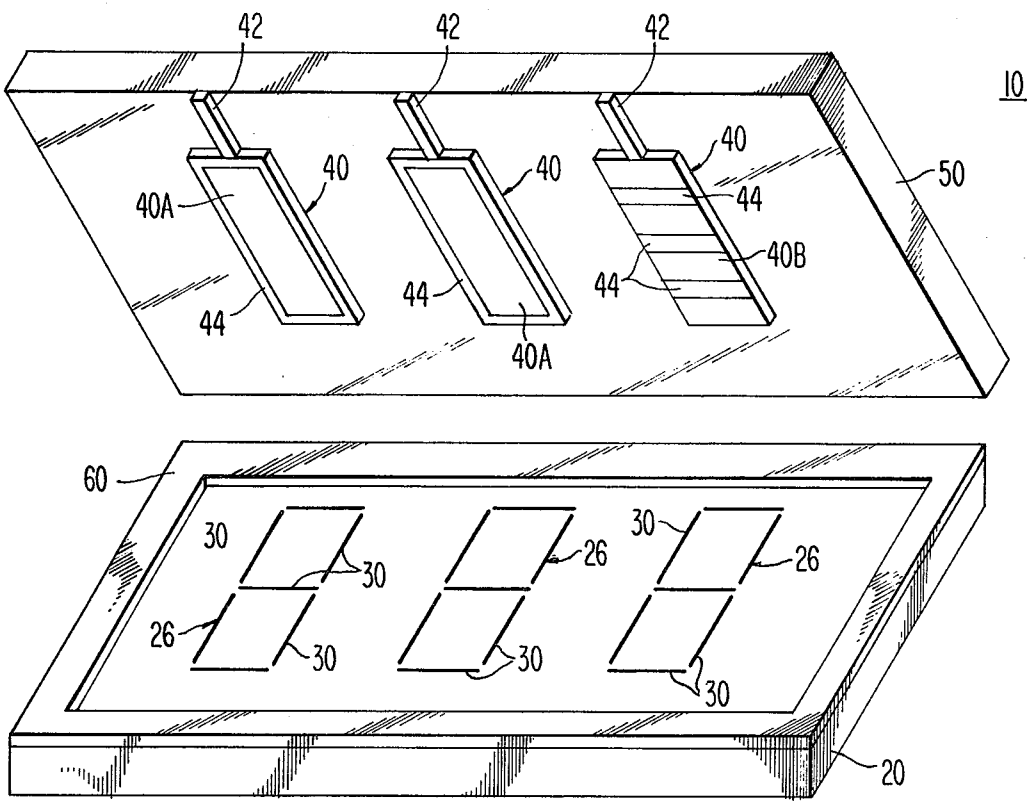
10
50
40
44
40B
42
44
40
40A
42
44
40
42
44
40A
20
26
30
30
26
30
30
30
30
26
60

AIR FIREABLE INK

BACKGROUND OF THE INVENTION

Gas-filled cold cathode display devices such as PANAPLEX panels and SELF-SCAN panels include cathode glow electrodes and transparent conductive anode electrodes. In addition to the gas filling, these panels usually include mercury vapor to minimize cathode sputtering. In some of these devices in which the anodes have relatively large area, they are reinforced and their conductivity is increased by means of a conductor of silver or the like which is provided along the perimeter of the electrode. In the case of a dot matrix panel, the reinforcement is applied in the form of X and Y conductors. The reinforcement conductors extend through the glass seal to form durable external connection pads. Although silver or silver alloys are commonly used as the reinforcing metal, the high affinity of these materials for mercury vapor and their relatively high cost limit their usefulness. Nickel and aluminum inks have also been used to replace silver, but each has certain drawbacks such as high firing temperatures, the need for special atmospheres for firing, poor conductivity, and incompatability with the transparent conductor coatings and materials used in forming a hermetic seal. All of these problems are solved by the ink of the invention.

DESCRIPTION OF THE DRAWINGS

The drawing is a perspective exploded view of a display panel which illustrates use of the invention.

DESCRIPTION OF THE INVENTION

The ink or thick film paste of the invention may be used in many devices such as a PANAPLEX panel of the type described in U.S. Pat. No. 3,868,535, dated Feb. 25, 1975, of George A. Kupsky, or in a SELF-SCAN panel of the type described in U.S. Pat. No. Re. 29,858, dated Dec. 5, 1978, of Donald E. Miller.

For purposes of illustration, portions of a PANAPLEX panel are shown in the drawing. Such a panel 10 includes a glass base plate 20 and a glass face plate 50 which are hermetically sealed together to form the panel envelope which is filled with an ionizable gas such as argon, neon, xenon, or the like, either singly or in combination. The base plate 20 carries on its top surface a plurality of groups 26 of cathode electrodes 30 in the form of segments, shown schematically, which are adapted to be energized in different combinations to display characters, as is well known in the art. The base plate also carries leads for the cathode electrodes and suitable insulating means as required; however, these are not shown, to simplify the drawing. The panel 10 also includes a transparent conductive anode electrode 40, of tin oxide or the like, for each group of cathode electrodes, with these electrodes 40 being formed on the lower surface of the face plate 50. The anodes 40 are provided with contact pads 42 along an edge of the face plate by which external contact is made to the anodes.

According to the invention, a reinforcing conductor 44, using the ink of the invention, is provided along the perimeter of the anodes as illustrated with anode 40A. If desired, the reinforcing conductor 44 may be a series of conductors across the anode as in anode 40B, or it may be an X-Y matrix (not shown), or it may have any suitable form. The material of the reinforcing conductor may also be used to form the pads 42.

The ink or thick film paste of the invention which is used to form the reinforcing conductors utilizes aluminum as an important component and includes nickel powder, aluminum powder, aluminum/silicon alloy powder, a binder, and a vehicle. The nickel powder has an average particle size of about one micron; the aluminum powder has an average size of about three microns; and the aluminum/silicon alloy powder has a particle size in the range of five to ten microns. One suitable aluminum/silicon alloy is Valimet's H-10, which is a blackish gray, spherial material with about 88% aluminum and about 12% silicon in its composite ratio. It is a high conductivity metal alloy powder, and, when added to the ink formulation, it yields a dark conductive cermet.

| Material | % by weight |
|---|---|
| The ink has the following formulation: | |
| Nickel | 34–55 |
| Aluminum | 10–14 |
| Aluminum/silicon alloy | 18–24 |
| Lead glass frit binder | 16–20 |
| Vehicle | 12–14 |
| The preferred formulation includes: | |
| Nickel | 38 |
| Aluminum | 20 |
| Aluminum/silicon alloy | 12 |
| Lead glass frit binder | 18 |
| Vehicle | 12 |

In one suitable formulation, the lead glass frit binder used was that sold by Owens-Illinois as SG-67 binder which includes lead borosilicate glass. Other glass binders might also be used.

The vehicle includes a solvent such as alpha terpenol, ethyl cellulose and small quantities of lauric acid, triethanol amine and a wetting agent to control the flow properties of the ink. Other vehicle mixtures could be used.

In using the ink formulation of the invention, the anodes 40 are formed on the face plate, and then the desired formulation for reinforcing conductors 44 is prepared and screened on the face plate outlining the anodes or in any desired pattern. After the screening operation, the face plate assembly is fired in air at a temperature in the range of 575° C. to 585° C. The other portions of the panel are prepared in well known fashion and are assembled with the face plate, and then the panel is processed to completion as required.

The ink formulation of the invention has many advantages including the advantage that the firing temperature is lower than that required for known aluminum inks which must be fired above 600° C. Also, the nitrogen atmosphere required for most nickel inks is not used for the new inks. Both the nitrogen atmosphere and the firing temperatures over 590° C. degrade transparent conductive anode materials. In addition, the conductors 44 which are produced have a high conductivity of about 20 to 25 milliohms per square at a thickness of about 0.8 mil as compared with typical aluminum and nickel resistivities in excess of 100 milliohms/square. They also are dark in color and non-reflective so that good light contrast is achieved, and they can be screened in fine lines, if desired, on any type of support including a transparent conductive coating such as tin oxide. The conductors 44 and pads 42 also form a good hermetic seal with commercial sealing glasses. Finally, the inks of the invention are relatively low in cost.

It will be clear to those skilled in the art that the ink of the invention is not limited to the application described and that it can be used in other thick film applications.

What is claimed is:

1. An ink formulation for forming conductive elements by a screening operation including in percent by weight, nickel 34–55; aluminum 10–14; aluminum/silicon alloy 18–24; lead glass frit binder 16–20; and a vehicle 12–14, the nickel having an average particle size of about one micron; the aluminum having an average particle size of about three microns; and the aluminum/silicon alloy having a particle size in the range of five to ten microns.

2. An ink formulation for forming conductive elements by a screening operation including in percent by weight, nickel 38; aluminum 20, aluminum/silicon alloy 12, lead glass frit binder 18; and a vehicle 12 the nickel having an average particle size of about one micron; the aluminum having an average size of about three microns; and the aluminum/silicon alloy having a particle size in the range of five to ten microns.

3. The ink formulation defined in claim 1 wherein the aluminum/silicon alloy comprises about 88% aluminum and about 12% silicon.

4. A display panel comprising a gas-filled envelope made up of a base plate and a glass face plate hermetically sealed together to form said envelope which is filled with an ionizable gas, at least one glow cathode electrode in said envelope, a transparent conductive anode electrode on said face plate inside said envelope positioned in operative relation with said cathode electrode, and a reinforcing conductor in contact with at least a portion of said anode electrode, said reinforcing conductor being screened on said face plate with an ink formulation including in percent by weight, nickel 34–55, aluminum 10–14, aluminum/silicon alloy 18–24, lead glass frit binder 16–20, and a vehicle 12–14, the nickel having an average particle size of about one micron, the aluminum having an average particle size of about three microns, and the aluminum/silicon alloy having a particle size in the range of five to ten microns.

5. The panel defined in claim 4 wherein said ink formulation includes in percent by weight, nickel 38, aluminum 20, aluminum/silicon alloy 12, lead glass frit binder 18, and a vehicle 12.

6. The panel defined in claim 4 wherein, in the ink formulation, the aluminum/silicon alloy comprises about 88% aluminum and about 12% silicon.

* * * * *